US008240656B2

(12) United States Patent
Iizuka

(10) Patent No.: US 8,240,656 B2
(45) Date of Patent: Aug. 14, 2012

(54) PAPER FEEDING DEVICE, IMAGE FORMING APPARATUS, AND SETTING INFORMATION SWITCHING METHOD

(75) Inventor: Chiaki Iizuka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 991 days.

(21) Appl. No.: 11/966,339

(22) Filed: Dec. 28, 2007

(65) Prior Publication Data

US 2008/0315513 A1 Dec. 25, 2008

Related U.S. Application Data

(60) Provisional application No. 60/944,964, filed on Jun. 19, 2007.

(51) Int. Cl.
*B65H 7/08* (2006.01)

(52) U.S. Cl. ..... 271/111; 271/110; 271/171

(58) Field of Classification Search ..... 271/171, 271/111, 110

See application file for complete search history.

(56) References Cited

U.S. PATENT DOCUMENTS

| | | | | | |
|---|---|---|---|---|---|
| 4,190,246 | A * | 2/1980 | Sasuga | 271/145 |
| 4,484,734 | A * | 11/1984 | Tsudaka et al. | 271/9.03 |
| 5,110,106 | A * | 5/1992 | Matsumura et al. | 271/9.06 |
| 5,483,889 | A * | 1/1996 | Hoberock et al. | 101/232 |
| 5,574,551 | A * | 11/1996 | Kazakoff | 399/45 |
| 5,963,754 | A * | 10/1999 | Itoh et al. | 399/21 |
| 2004/0056413 | A1 * | 3/2004 | Shirakura et al. | 271/145 |

FOREIGN PATENT DOCUMENTS

| | | |
|---|---|---|
| JP | 08-137012 | 5/1996 |
| JP | 2006-058712 | 3/2006 |

* cited by examiner

*Primary Examiner* — Kaitlin Joerger
*Assistant Examiner* — Ernesto Suarez
(74) *Attorney, Agent, or Firm* — Turocy & Watson, LLP

(57) ABSTRACT

To provide a paper feeding device that can switch setting information only with an easy action of sheet removal and setting in a predetermined position. The paper feeding device includes a first detecting unit that detects whether a sheet is set in a predetermined position, a second detecting unit that detects whether the sheet removal and setting is performed in the predetermined position after the setting of the sheet is detected by the first detecting unit, and a switching unit that switches setting information concerning the sheet when the sheet removal and setting is detected by the second detecting unit.

14 Claims, 7 Drawing Sheets

FIG.2

| | | | WIDTH(mm) | | | | |
|---|---|---|---|---|---|---|---|
| | | | SHEET WIDTH DETECTION SENSOR 51a =OFF | SHEET WIDTH DETECTION SENSOR51a =ON | SHEET WIDTH DETECTION SENSOR51b =ON | SHEET WIDTH DETECTION SENSOR51c =ON | SHEET WIDTH DETECTION SENSOR51d =ON |
| | | | | 196mm OR LESS | 197 TO 236mm | 237 TO 268mm | 269mm OR MORE |
| LENGTH (mm) | SHEET LENGTH DETECTION SENSOR =OFF | 314mm OR LESS | NO SHEET | B5-R IS PRESENT | A4-R OR LT-R IS PRESENT | B5 IS PRESENT | LT OR A4 IS PRESENT |
| | SHEET LENGTH DETECTION SENSOR =ON | 314mm OR MORE | NO SHEET | NO CORRESPONDING SHEET SIZE | LG IS PRESENT | B4 IS PRESENT | LD OR A3 IS PRESENT |

PAPER FEEDING DEVICE, IMAGE FORMING APPARATUS, AND SETTING INFORMATION SWITCHING METHOD

BACKGROUND OF THE INVENTION

1. Field of the Invention

The present invention relates to a paper feeding device, an image forming apparatus, and a setting information switching method that enable switching of setting information concerning a sheet, and, more particularly to switching of series information concerning a sheet size.

2. Description of the Related Art

An inserter (a paper feeding device) connectable to an MFP (Multi Function Peripheral) is a device that inserts a front cover, insertion paper, a back cover, and the like in bookbinding.

The inserter includes plural sensors that detect the width and the length of a sheet in order to notify the MFP of a sheet size of a sheet set in a tray of the inserter. The inserter notifies the MFP of detected information concerning the sheet size. The MFP compares the notified information and sheet sizes of sheets (the sheet sizes are also detected by the sensors) set in paper feeding cassettes, paper feeding trays, and an ADF (Auto Document Feeder). When the sheet sizes mismatch, in order to prevent a poor finish of bookbinding (a bookbinding side is uneven because of the mismatch of the sheet sizes) and prevent paper jamming (in the case of an image forming apparatus having an automatic staple function, although sheets are aligned before stapling, paper jamming occurs when sheet sizes mismatch at this point), in general, the MFP performs control to prevent printing from being continued.

As the sheet sizes, there are series of sheet sizes such as an A4 size and a B4 size mainly used in Japan specified by the JIS standard (JIS: Japanese Industrial Standards) (hereinafter referred to as A series) and series of sheet sizes such as a Legal size and a Letter size mainly used in Europe and the United States (hereinafter referred to as LT series). For example, the A4 size (210 mm×297 mm) and the Letter size (216 mm×279 mm) are very close sheet sizes and A3 (420 mm×297 mm) and Ledger (432 mm×279 mm) are also very close sheet sizes. Differences in these sheet sizes also need to be detected for prevention of deficiencies in finish of bookbinding and prevention of paper jamming.

When the differences caused by the series are identified by sensors, a large number of sensors are necessary as shown in an inserter side view in FIG. 7 and an inserter plan view in FIG. 8 (e.g., to distinguish ten kinds of sheet sizes (B5-R, A4-R, LT-R, LG, B5, B4, LT, A4, LD, and A3), an inserter 300 needs at least seven sensors in total including six sheet width detection sensors 301 and one sheet length detection sensor 302). Since the sensors are required to have high position accuracy, manufacturing cost of the sensors is high.

There is also an inserter of a volume type (see FIG. 8) that reads, to read a sheet size, a voltage that varies in association with the width between sheet regulating plates 303 without using sheet size detection sensors for respective sizes and converts the voltage into a distance between the sheet regulating plates 303 to detect a sheet width size. However, like the mechanism for detecting sheet widths with the sensors, it is difficult to distinguish sheet sizes with the inserter of the volume type when sheet widths are close (e.g., the A4 size and the Letter size).

Therefore, in order to cause the MFP to determine the two series of close sheet sizes, i.e., the A series and the LT series, a user sets in advance, using a switch on an operation panel provided in the inserter or the MFP, whether sheet sizes are the A series or the LT series used in the inserter. However, the switching of the A series and the LT series by the switch has a problem in terms of convenience.

SUMMARY OF THE INVENTION

It is an object of an embodiment of the present invention to provide a paper feeding device, an image forming apparatus, and a setting information switching method for switching setting information (e.g., the A series and the LT series described above) concerning a sheet by applying conventionally provided sensors thereto.

In order to attain the object, a paper feeding device according to an aspect of the present invention includes a first detecting unit that detects whether a sheet is set in a predetermined position, a second detecting unit that detects whether the sheet removal and setting is performed in the predetermined position after the setting of the sheet is detected by the first detecting unit, and a switching unit that switches setting information concerning the sheet when the sheet removal and setting is detected by the second detecting unit.

An image forming apparatus according to another aspect of the present invention includes an image forming unit that forms an image on a supplied sheet and a paper feeding device that feeds a sheet to the image forming unit. The paper feeding device includes a first detecting unit that detects whether a sheet is set in a predetermined position, a second detecting unit that detects whether the sheet removal and setting is performed in the predetermined position after the setting of the sheet is detected by the first detecting unit, and a switching unit that switches setting information concerning the sheet when the sheet removal and setting is detected by the second detecting unit.

A setting information switching method according to still another embodiment of the present invention includes detecting whether a sheet is set in a predetermined position, detecting whether the sheet removal and setting is performed in the predetermined position after the setting of the sheet is detected, and switching setting information concerning the sheet when the sheet removal and setting is detected.

DESCRIPTION OF THE DRAWINGS

FIG. 2 is a table for determining a sheet size from ON and OFF of a sheet width detection sensor and a sheet length detection sensor according to the embodiment;

DESCRIPTION OF THE EMBODIMENTS

An embodiment of the present invention will be hereinafter explained in detail with reference to the accompanying drawings. In this embodiment, when sheet removal and setting is performed within a predetermined time (e.g., one second), setting information concerning the sheet is switched. In the explanation of this embodiment, series of sheet sizes of the A series and the LT series are setting information concerning a sheet.

Figure 1:
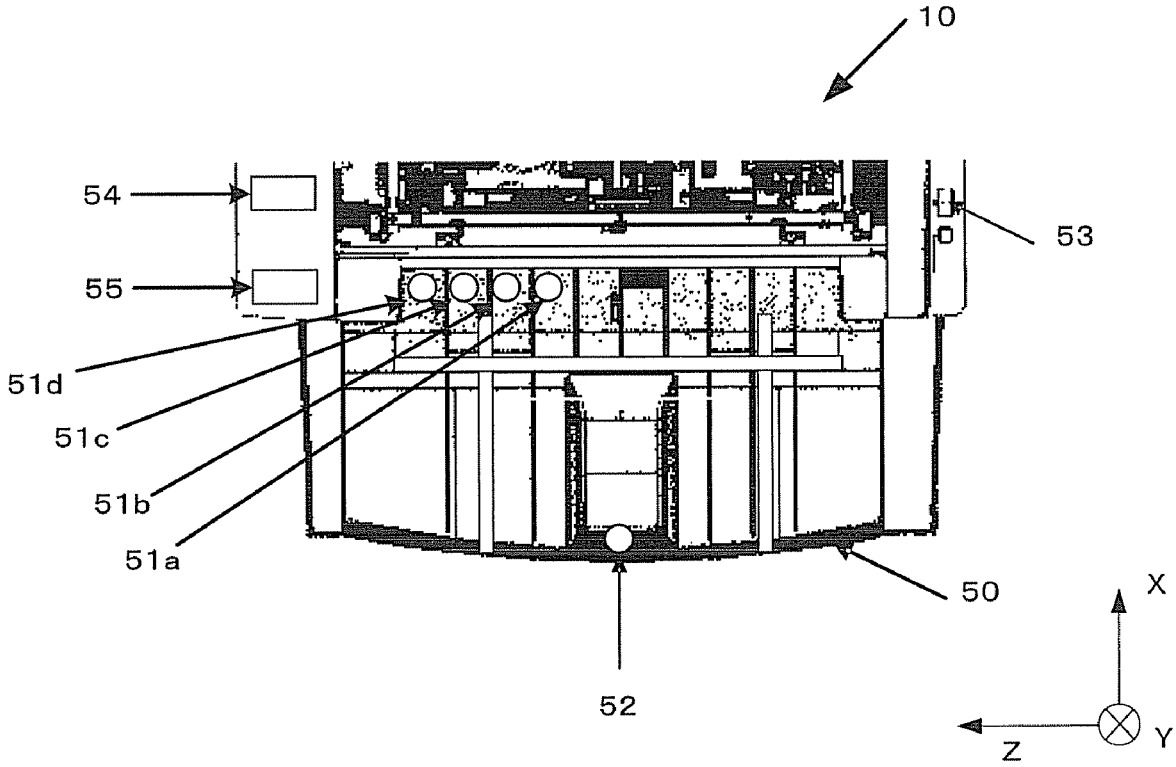
FIG. 1 is a plan view showing an example of the structure of an inserter according to an embodiment of the present invention.

In FIG. 1, a plan view of an inserter according to this embodiment (a plan view of the inserter viewed from above) is shown.

An inserter 10 according to this embodiment includes a paper feeding tray 50 for setting an inserted sheet (hereinafter simply referred to as sheet) in a predetermined position and an inserter indicator panel 53 that indicates, with lighting of LEDs, which of the A series and the LT series is presently set. The inserter 10 also includes a setting information switching circuit 54 that switches information concerning series of sheet sizes (hereinafter referred to as sheet series information (setting information)) from the LT series to the A series or the A series to the LT series and outputs the switched sheet series information to the inserter indicator panel 53 and an MFP 20 (described later) (the setting information switching circuit 54 also outputs sheet size information (described later) to the MFP 20).

The inserter 10 further includes a removal and setting detection circuit 55 that detects switching of OFF (a state in which a sheet is removed) and ON (a state in which a sheet is set) within a predetermined time of a sheet width detection sensor 51*a*.

The paper feeding tray 50 includes four sheet width detection sensors 51*a*, 51*b*, 51*c*, and 51*d* (hereinafter collectively referred to as sheet width detection sensors 51) that detect the width (a Z axis direction in FIG. 1) of the set sheet and a sheet length detection sensor 52 that detects the length (an X axis direction in FIG. 1) of the sheet. In this embodiment, the sheet is set such that a center axis of the paper feeding tray 50 and a center axis of the sheet substantially coincide with each other.

A sheet size of the sheet set in the paper feeding tray 50 is detected according to ON and OFF of the plural sheet width detection sensors 51 and the sheet length detection sensor 52. The detection of a sheet size is explained with reference to FIG. 2.

The sheet width detection sensors 51 and the sheet length detection sensor 52 are ON when a sheet covers the respective sensors and are OFF when a sheet does not cover the respective sensors. A sheet size is detected on the basis of ON and OFF of the respective sensors.

For example, when the sheet length detection sensor 52 is OFF (sheet length is equal to or smaller than 314 mm), it is detected that a sheet is not set when the sheet width detection sensors 51*a* are OFF and it is detected that a sheet of a B5-R size (landscape B5 size) is set when only the sheet width detection sensor 51*a* is ON. Similarly, when the sheet length detection sensor 52 is OFF (sheet length is equal to or smaller than 314 mm), it is detected that a sheet of an A4-R size or an LT-R size is set when the sheet width detection sensor 51*b* is ON (naturally, the sheet width detection sensor 51*a* is ON because the sensor is covered by the sheet). In the same manner, sheet sizes are detected on the basis of states of ON and OFF of the sheet width detection sensor 51*c* and the sheet width detection sensor 51*d*. When the sheet length detection sensor 52 is ON, a sheet size is detected as described above.

In the sensor structure described above, differences in sheet sizes that are different according to the A series and the LT series such as a difference in sheet sizes between the A4 size and the LT size as small as a few millimeters cannot be detected. In this embodiment, information concerning ON and OFF of the various sensors is transmitted to the MFP 20 as sheet size information.

The sheet width detection sensor 51*a* can detect, according to ON and OFF of the sensors, whether a sheet is set in the paper feeding tray 50 as described above. While the sheet width detection sensor 51*a* is ON, when the sheet width detection sensor 51*a* is turned off and, then, turned on within a predetermined time (e.g., one second), the removal and setting detection circuit 55 detects that sheet removal and setting is performed.

When the sheet width detection sensor 51*a* changes from OFF to ON within the predetermined time, the setting information switching circuit 54 switches sheet series information from the LT series to the A series or from the A series to the LT series and outputs the sheet series information after the switching to the inserter indicator panel 53.

Figure 3:
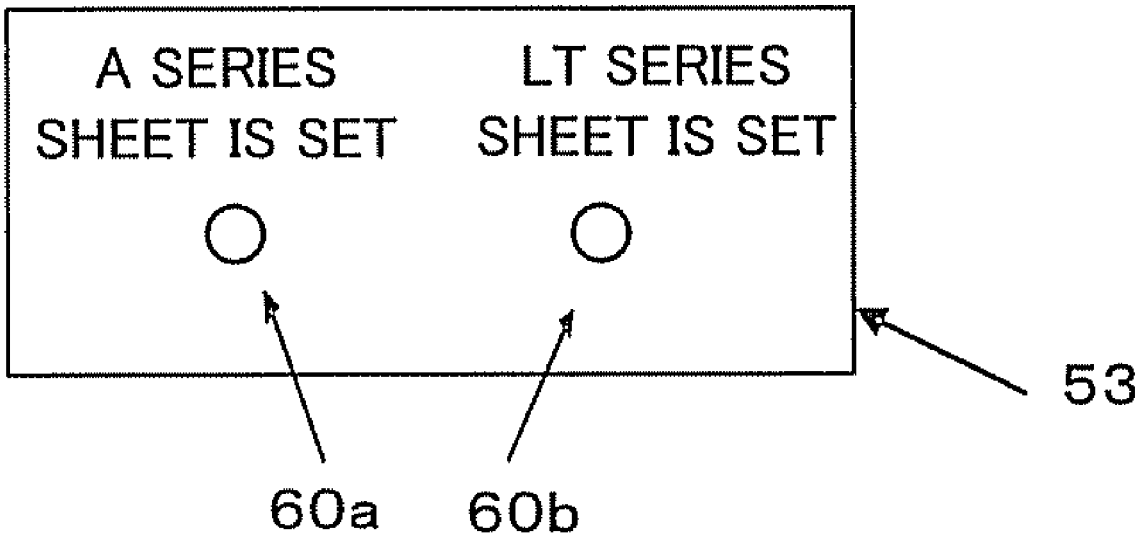
FIG. 3 is a diagram showing an example of an inserter indicator panel according to the embodiment.

An example of the inserter indicator panel 53 is shown in FIG. 3. When the inserter indicator panel 53 acquires sheet series information, the inserter indicator panel 53 switches lighting of LEDs (an LED 60*a* and an LED 60*b* of the inserter indicator panel 53 shown in FIG. 3) to indicate series of the present sheet size. When the sheet width detection sensor 51*a* changes from OFF to ON within the predetermined time, the setting information switching circuit 54 outputs the present series of the A series or the LT series to the MFP 20 as sheet series information and also outputs sheet size information. The sheet size information outputted by the setting information switching circuit 54 is outputted as information that is not distinguished in a difference of a few millimeters, for example, between the A4 size and the LT size. However, since the sheet series information is also outputted, the MFP 20 can distinguish the difference of a few millimeters on the basis of the sheet series information.

Figure 4:
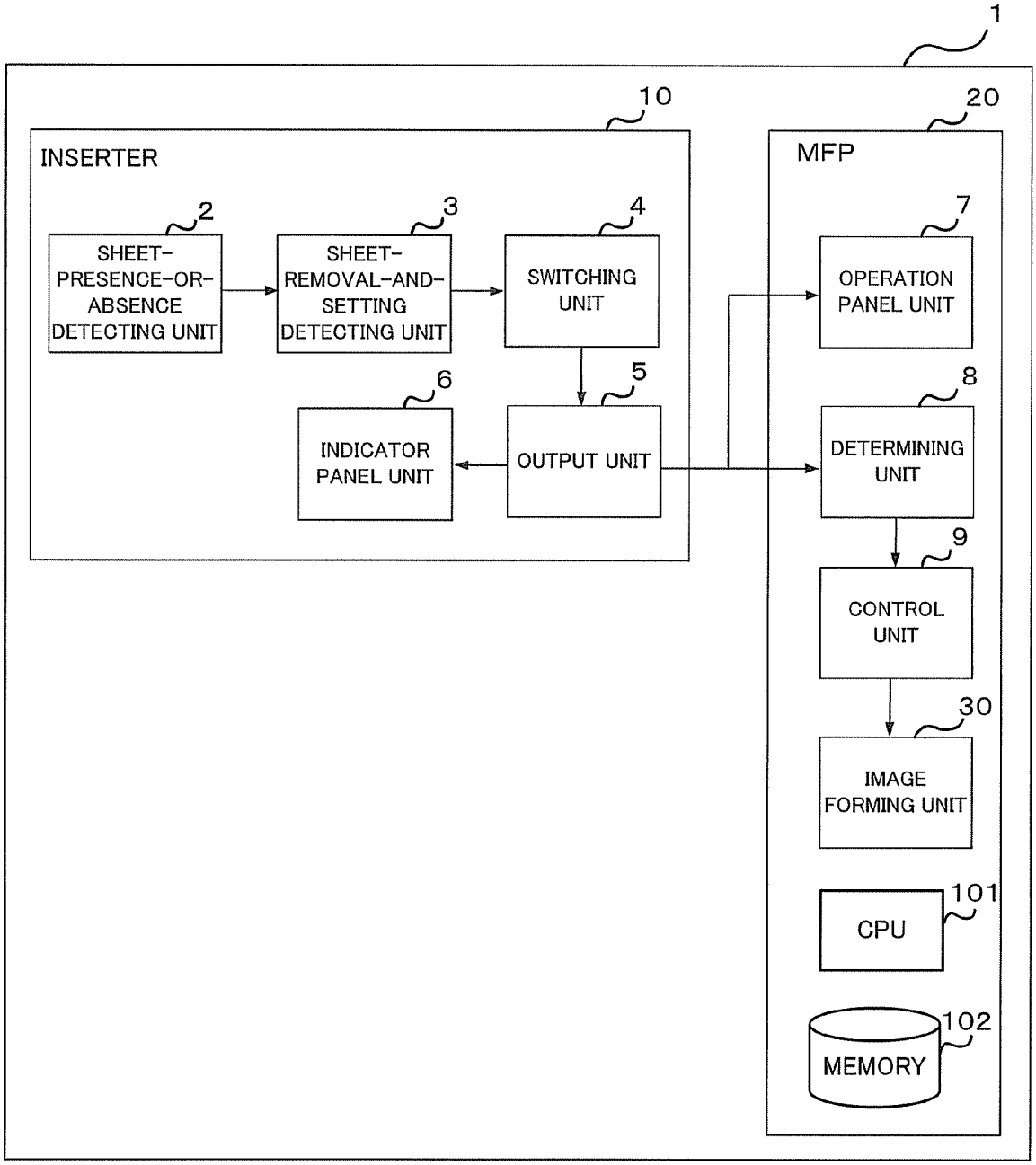
FIG. 4 is a block diagram showing an example of functions of an image forming apparatus according to the embodiment.

Functions of an image forming apparatus according to this embodiment are explained with reference to functional blocks in FIG. 4. An image forming apparatus 1 includes the inserter 10 and the MFP 20.

The inserter 10 includes a sheet-presence-or-absence detecting unit 2 (a first detecting unit), a sheet-removal-and-setting detecting unit 3 (a second detecting unit), a switching unit 4, an output unit 5, and an indicator panel unit 6 (an indicating unit).

The sheet-presence-or-absence detecting unit 2 detects whether a sheet is set in a predetermined position of the paper feeding tray 50. The sheet-removal-and-setting detecting unit 3 detects whether sheet removal and setting in the paper feeding tray 50 is performed within a predetermined time after the setting of the sheet is detected by the sheet-presence-or-absence detecting unit 2.

When the sheet removal and setting is detected by the sheet-removal-and-setting detecting unit 3, the switching unit 4 switches sheet series information, which is information concerning series of a sheet size. The output unit 5 outputs the sheet series information switched by the switching unit 4 to the indicator panel unit 6 and an operation panel unit 7 in the MFP 20 and outputs the sheet series information and sheet size information to a determining unit 8.

The indicator panel unit 6 acquires the sheet series information outputted by the output unit 5 and indicates, on the basis of the acquired information, which series of a sheet size the series of the sheet size of the sheet is.

The sheet-presence-or-absence detecting unit 2 corresponds to the sheet width detection sensor 51*a*. The sheet-removal-and-setting detecting unit 3 corresponds to the removal and setting detection circuit 55 and the sheet width detection sensor 51*a*. The switching unit 4 and the output unit 5 correspond to the setting information switching circuit 54. The indicator panel unit 6 corresponds to the inserter indicator panel 53.

The MFP 20 further includes an operation panel unit 7 (an indicating unit), a determining unit 8, a control unit 9, and an image forming unit 30. A CPU 101 has a role of performing various kinds of processing in the MFP 20 and also has a role of realizing various functions by executing programs stored in a MEMORY 102. The MEMORY 102 includes a ROM and a RAM and has a role of storing various kinds of information and programs used in the MFP 20.

The operation panel unit 7 includes a liquid crystal panel. The operation panel unit 7 acquires the sheet series information outputted by the output unit 5 and indicates, on the basis of the sheet series information, which series of a sheet size the series of the sheet size of the sheet is.

The determining unit 8 determines, on the basis of the sheet series information and the sheet size information outputted by the output unit 5, a sheet size of the sheet set in the paper feeding tray 50 of the inserter 10 (here, as the sheet size, even a difference of a few millimeters between, for example, the A4 size and the LT size is detected because the sheet series information is also taken into account; such a sheet size is hereinafter referred to as a sheet size with series taken into account). The determining unit 8 determines whether the sheet size with series taken into account and sheet sizes of sheets set in devices other than the paper feeding tray 50 of the inserter 10 (e.g., an ADF, paper feeding cassettes, and paper feeding trays (not shown in the figure) in the MFP 20) match.

The control unit 9 controls, on the basis of a result of the determination by the determining unit 8, whether image formation should be performed.

The image forming unit 30 carries out the image formation on the basis of the control by the control unit 9.

Figure 5:
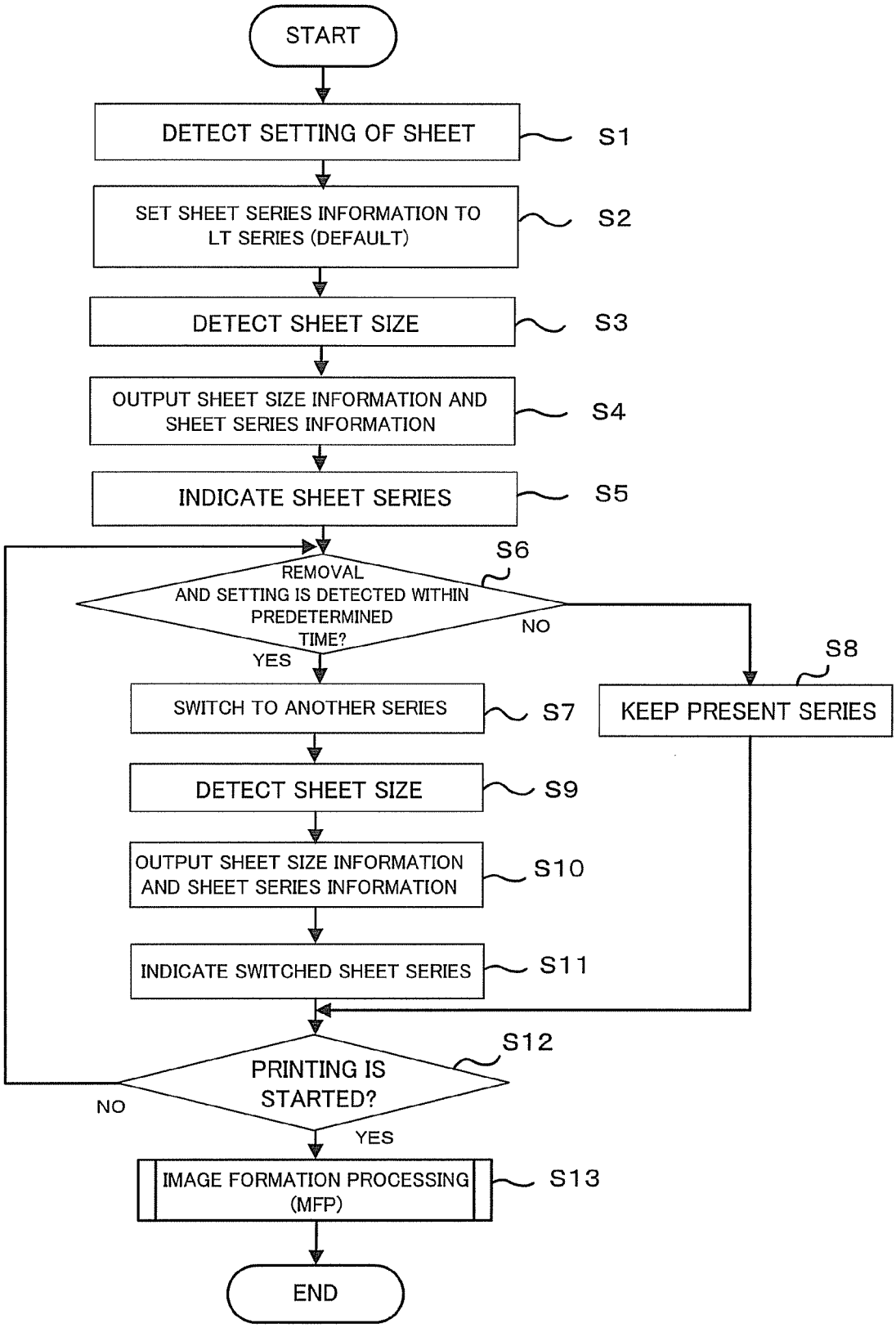
FIG. 5 is a flowchart showing an example of processing of the image forming apparatus according to the embodiment.

Processing in this embodiment is explained with reference to a flowchart in FIG. 5. In the following explanation, series of a sheet size of the inserter 10 is the LT series in an initial state (default).

The sheet-presence-or-absence detecting unit 2 detects that a sheet is set (step S1), whereby sheet series information is set to the default LT series (step S2). Subsequently, the sheet width detection sensor 51 and the sheet length detection sensor 52 detect a sheet size (step S3). As the sheet size, a difference between, for example, the LT size and the A4 size is not detected.

The output unit 5 outputs the sheet series information to the operation panel unit 7 and the determining unit 8 of the MFP 20 and the indicator panel unit 6 of the inserter 10 (and further outputs sheet size information to the determining unit 8) (step S4). The indicator panel unit 6 and the operation panel unit 7 acquire the sheet series information outputted by the output unit 5 and indicate which series of a sheet size (the A series or the LT series) the present series of the sheet size is (step S5). The indicator panel unit 6 indicates, by lighting the LEDs 60*a* and 60*b*, which series of a sheet size the present series of the sheet size is. The operation panel unit 7 indicates, as character information, which series of a sheet size the present series of the sheet size is on the liquid crystal panel of the operation panel unit 7. Since the default is the LT series, it is indicated that the present series of a sheet size is the LT series.

In a state in which a sheet is set, the sheet-removal-and-setting detecting unit 3 detects whether sheet removal and setting is performed within a predetermined time (e.g., one second) (step S6).

When the sheet-removal-and-setting detecting unit 3 detects the sheet removal and setting (step S6, YES), the switching unit 4 switches the sheet series information from the present series (the LT series) to another series (the A series) (step S7).

When the sheet series information is switched in this way, a sheet size of the set sheet is detected again (step S9). Thereafter, the output unit 5 outputs the sheet series information to the operation panel unit 7 and the determining unit 8 of the MFP 20 and the indicator panel unit 6 of the inserter 10 (and further outputs sheet size information to the determining unit 8) (step S10). The indicator panel unit 6 and the operation panel unit 7 acquire the sheet series information outputted by the output unit 5 and indicate which series of a sheet size the present series of the sheet size is (the A series are indicated here) (step S11).

On the other hand, when the sheet removal and setting is not detected in step S6 (step S6, NO), the series of a sheet size is kept as the present series (here, the LT series) (step S8) and the processing proceeds to step S12.

The processing from step S6 to step S11 is performed until printing is started (step S12) (a loop from NO in step S12 to step S6). When printing is started (step S12, YES), image formation processing is started in the MFP 20 (step S13).

Figure 6:
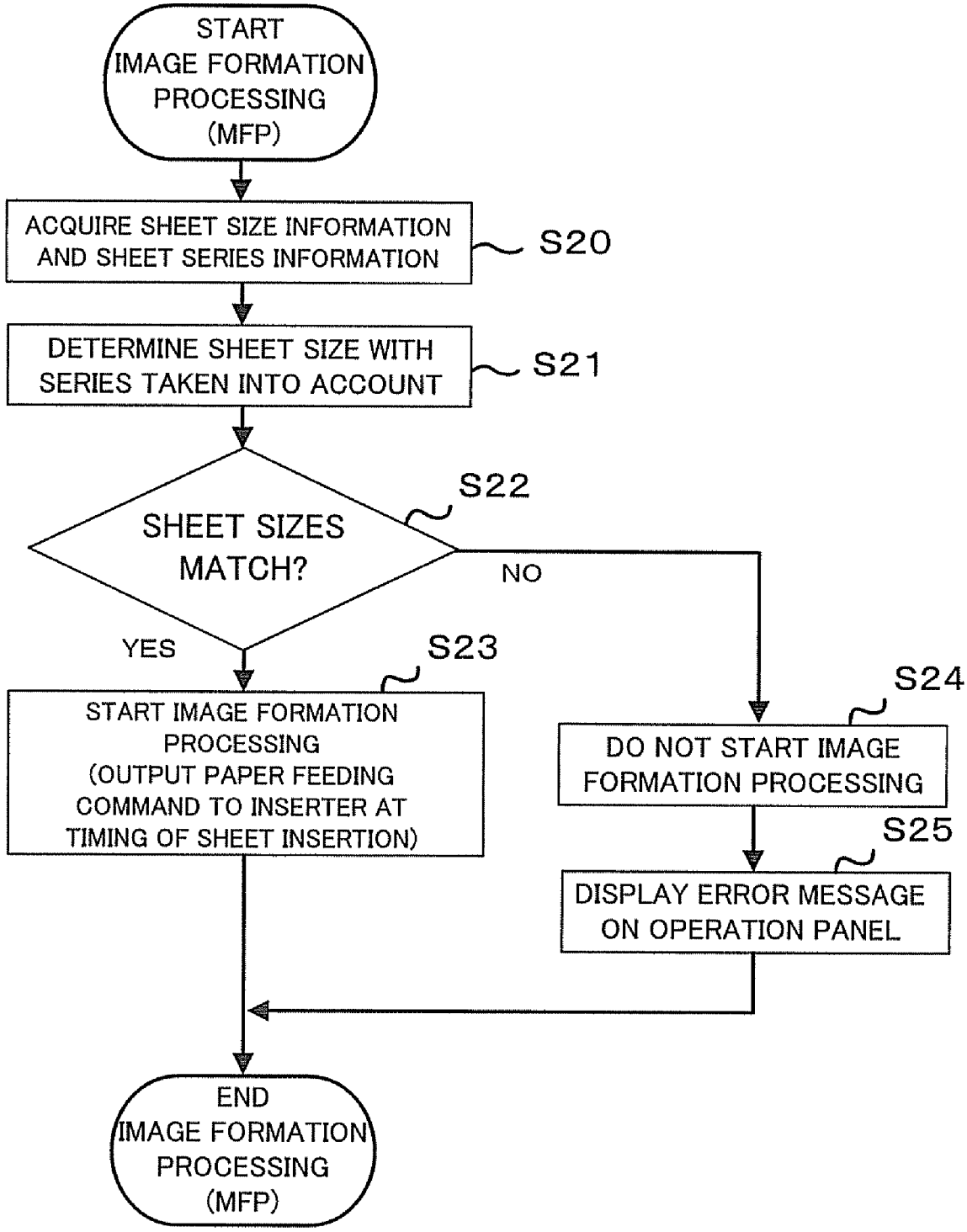
FIG. 6 is a flowchart showing an example of image forming processing of an MFP according to the embodiment.
Figure 7:
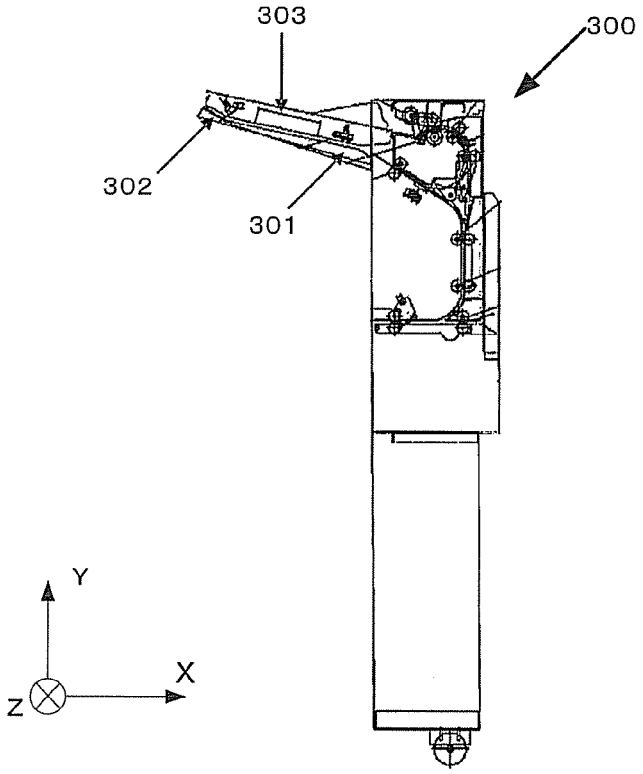
FIG. 7 is a side view showing the structure of an inserter including six sheet width detection sensors.
Figure 8:
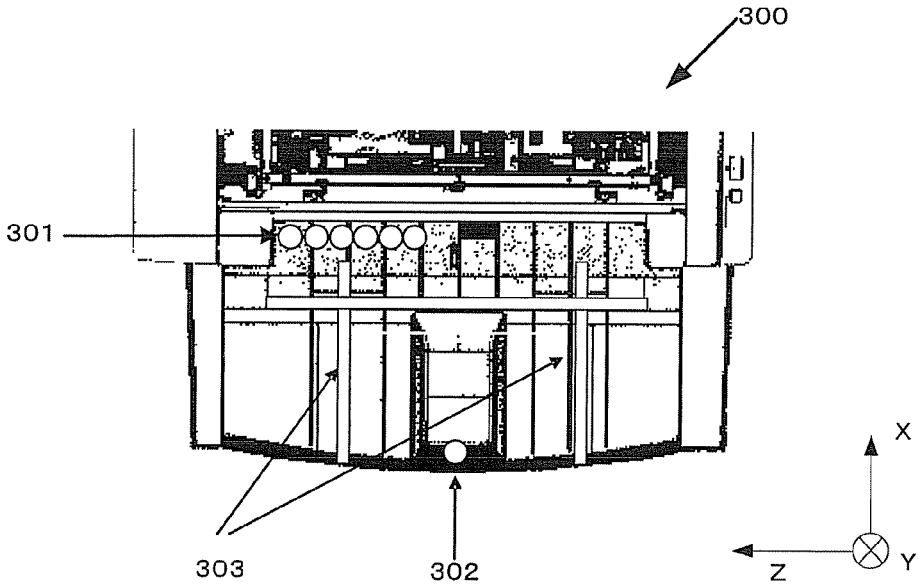
FIG. 8 is a plan view showing the structure of the inserter including six sheet width detection sensors.

The image formation processing in the MFP 20 is explained with reference to a flowchart in FIG. 6.

The determining unit 8 acquires sheet series information and sheet size information (step S20) and determines, on the basis of the acquired sheet series information and sheet size information, a sheet size with series taken into account of a sheet set in the paper feeding tray of the inserter 10 (step S21). Thereafter, the determining unit 8 determines whether the sheet size with series taken into account matches sheet sizes of sheets set in other paper feeding devices (e.g., the ADF, the paper feeding cassettes, and the paper feeding trays provided in the MFP 20) (step S22). When the sheet sizes match (step S22, YES), the control unit 9 controls the image forming unit 30 to start image formation and the image forming unit 30 starts the image formation (step S23). The image forming unit 30 outputs a paper feeding command to the inserter 10 at timing of sheet insertion.

On the other hand, when it is determined in step S22 that the sheet sizes do not match (step S22, NO), in order to prevent paper jamming and a deficiency in finish of bookbinding caused by the sheet mismatch, the control unit 9 controls the image forming unit 30 not to perform image formation (step S24). The operation panel unit 7 displays an error message that indicates that the sheets mismatch (step S25).

With such a constitution, it is possible to obtain an accurate sheet size without increasing sensors for detecting sheet sizes of the A series and the LT series.

In this embodiment, the determining unit 8 of the MFP 20 determines the sheet size with series taken into account from the sheet size information and the sheet series information. However, the switching unit 4 of the inserter 10 may determine the sheet size with series taken into account. In that case, information outputted from the output unit 5 to the determining unit 8 may be only information concerning the sheet size with series taken into account.

The determining unit 8 may acquire only the sheet series information and determine, without taking into account a sheet size, whether series of the acquired sheet series information and series set by the other paper feeding devices match.

In this embodiment, the inserter is explained as an example of the paper feeding device. However, the present invention is also applicable to paper feeding devices such as an ADF (Auto Document Feeder), a manual feed tray, and paper feeding cassettes provided in the MFP.

In this embodiment, the setting information to be switched is explained as the information of series of a sheet size. However, for example, it is also possible that sheet types of an unused sheet (a sheet whose both sides are not used yet) and a reverse side paper (a sheet whose one side is already used and whose unused rear side is used for reuse of the sheet) are defined as setting information concerning the sheets (e.g., an initial value is the unused sheet and, when sheet removal and setting is detected, the initial value is changed to setting information of the rear side paper) and these kinds of setting information are switched.

It is also possible that sheet types such as thick paper or plain paper are defined as setting information concerning sheets (e.g., an initial value of setting information is set as the plain paper and, when sheet removal and setting is detected, the setting information changes to the thick paper) and these kinds of setting information are switched.

It is also possible that sheet types such as a difference in colors of sheets and presence or absence of a pattern of the sheets are defined as setting information concerning the sheets (e.g., an initial value of the setting information is set as white and, when removal and setting is detected, the setting information changes to red) and these kinds of setting information are switched.

It is also possible that sheet types such as plain paper, glossy paper, and an OHP sheet are defined as setting information concerning sheets (e.g., an initial value of the setting information is set as the plain paper, when sheet removal and setting is performed once, the setting information changes to the glossy paper, when sheet removal and setting is performed twice, the setting information is changed to the OHP sheet, and, when sheet removal and setting is performed three times, the setting information returns to the plain paper) and these kinds of setting information are switched.

The present invention is also applicable to an inserter of a volume type that is constituted by providing sheet regulating plates in the inserter 10. The inserter of the volume type changes a voltage in association with the width between the sheet regulating plates, reads the voltage, converts the voltage into a distance between the sheet regulating plates, and detects a sheet width size.

In the explanation of this embodiment, after a sheet is detected by the sheet-presence-or-absence detecting unit 2, when sheet removal and setting is detected within the predetermined time (e.g., one second) (in other words, it is detected that sheet removal and setting is performed when an operation for sheet removal and setting is performed within the predetermined time and it is not detected that sheet removal and setting is performed when the operation is not performed within the predetermined time) and the setting information is switched. However, the setting information may be switched when sheet removal and setting is detected within a predetermined time (e.g., one minute) from a point when the sheet is detected by the sheet-presence-or-absence detecting unit 2.

The present invention has been explained in detail with reference to the specific forms. However, it would be obvious to those skilled in the art that various modifications and alterations are possible without departing from the spirit and the scope of the present invention.

As described above in detail, according to the present invention, setting information can be switched only by an easy action of sheet removal and setting in a predetermined position. Therefore, it is possible to provide a paper feeding device, an image forming apparatus, and a setting information switching method that are more excellent in convenience.

What is claimed is:

1. A paper feeding device comprising:

plural sensors arranged in a direction orthogonal to a sheet conveying direction and configured to detect the width of a sheet, a first detecting unit configured to detect whether a sheet is set in a predetermined position if at least one of the plural sensors is turned on;

a second detecting unit configured to detect whether a sheet removal and setting is performed if at least one of the plural sensors changes from ON to OFF and further changes to ON within a predetermined time in which the sheet is removed after the setting of the sheet is detected by the first detecting unit and set again in the predetermined position;

a switching unit configured to switch information concerning a series of a sheet size to a first series or a second series which is different from the first series when the sheet removal and setting is detected by the second detecting unit; and an indicating unit configured to indicate whether a sheet size is the first series or the second series on the basis of the information concerning the series of the sheet size, and configured to indicate the series switched as a sheet size when the information concerning the series of a sheet size is switched by the switching unit after the sheet removal and setting is detected by the second detecting unit.

2. A paper feeding device according to claim 1, further comprising an output unit configured to output the setting information switched by the switching unit.

3. A paper feeding device according to claim 2, wherein the indicating unit is further configured to acquire the setting information outputted by the output unit and indicate the setting information.

4. A paper feeding device according to claim 1, wherein the plural sensors have a sheet length detection sensor which is away from the sensors arranged in the direction orthogonal to the sheet conveying direction in the sheet conveying direction.

5. A paper feeding device according to claim 4, wherein the plural sensors have a first sensor arranged in the direction orthogonal to the sheet conveying direction and configured to detect an A4-R size sheet and a LT-R size sheet, the plural sensors have the sheet length detection sensor which is away from the sensors arranged in the direction orthogonal to the sheet conveying direction in the sheet conveying direction, wherein the paper feeding device detects that an A4-R size sheet or a LT-R size sheet is set when the first sensor is ON and the sheet length detection sensor is OFF.

6. A paper feeding device according to claim 1, wherein the first series is an A series and the second series is a LT series.

7. A paper feeding device according to claim 1, further comprising an output unit configured to output the sheet size information which the paper feeding device detects by using the plural sensors.

8. A setting information switching method comprising:

detecting whether a sheet is set in a predetermined position when one or more sensors are turned on;

detecting whether a sheet removal and setting is performed when one or more sensors change from ON to OFF and further changes to ON within a predetermined time in which the sheet is removed after the setting of the sheet is detected and set again in the predetermined position;

switching setting information concerning a series of a sheet size to a first series or a second series which is different from the first series when the sheet removal and setting is detected;

indicating with an indicating unit whether a sheet size is the first series or the second series on the basis of the information concerning the series of the sheet size; and indicating the series switched as a sheet size when the information concerning the series of a sheet size is switched by a switching unit after the sheet removal and setting is detected by the one or more sensors.

9. A setting information switching method according to claim 8, further comprising outputting the switched setting information.

10. A setting information switching method according to claim 9, further comprising acquiring the outputted setting information and indicating the setting information.

11. A setting information switching method according to claim 8, wherein the one or more sensors comprise a plurality of sensors arranged in a direction orthogonal to a sheet conveying direction and a sheet length detection sensor which is away from the sensors arranged in the direction orthogonal to the sheet conveying direction in the sheet conveying direction.

12. A setting information switching method according to claim 11, wherein the plural sensors have a first sensor arranged in the direction orthogonal to the sheet conveying direction and configured to detect an A4-R size sheet and a LT-R size sheet, the plural sensors have the sheet length detection sensor which is away from the sensors arranged in the direction orthogonal to the sheet conveying direction in the sheet conveying direction, wherein detecting that an A4-R size sheet or a LT-R size sheet is set when the first sensor is ON and the sheet length detection sensor is OFF.

13. A setting information switching method according to claim 8, wherein the first series is an A series and the second series is a LT series.

14. A setting information switching method according to claim 8, further comprising outputting the sheet size information detected by the sensor.

* * * * *